US006711841B2

(12) United States Patent
Glueckstein et al.

(10) Patent No.: US 6,711,841 B2
(45) Date of Patent: Mar. 30, 2004

(54) GAS DISCHARGE TUBE COVER

(75) Inventors: John Glueckstein, Hubertus, WI (US); Stephen E. Porter, Mt. Vernon, IL (US)

(73) Assignee: Everbrite, Inc., Greenfield, WI (US)

( * ) Notice: Subject to any disclaimer, the term of this patent is extended or adjusted under 35 U.S.C. 154(b) by 0 days.

(21) Appl. No.: 10/154,859

(22) Filed: May 24, 2002

(65) Prior Publication Data

US 2002/0184805 A1 Dec. 12, 2002

Related U.S. Application Data

(60) Provisional application No. 60/296,667, filed on Jun. 7, 2001.

(51) Int. Cl.[7] ..... G09F 13/26

(52) U.S. Cl. ..... 40/545; 40/581; 40/583; 362/260

(58) Field of Search ..... 40/545, 550, 581, 40/583; 362/260

(56) References Cited

U.S. PATENT DOCUMENTS

| | | | | | |
|---|---|---|---|---|---|
| RE18,679 | E | | 12/1932 | Hotchner | |
| 1,994,519 | A | | 3/1935 | James | |
| 2,025,356 | A | * | 12/1935 | Neal | 40/545 |
| 2,106,238 | A | | 1/1938 | Deans | |
| 2,262,444 | A | | 11/1941 | Faltings | |
| 2,296,893 | A | | 9/1942 | Austin | |
| 2,556,779 | A | | 6/1951 | Ross | |
| 2,562,740 | A | * | 7/1951 | Rizer | 40/545 |
| 2,618,089 | A | | 11/1952 | Rose | |
| 3,056,221 | A | | 10/1962 | Brienza | |
| 3,507,065 | A | | 4/1970 | Fullerton | |
| 3,775,886 | A | | 12/1973 | Anderson | |
| 3,808,495 | A | * | 4/1974 | Win | 362/223 |
| 4,727,459 | A | * | 2/1988 | Palumbo | 362/260 |
| 5,533,286 | A | | 7/1996 | Fallon et al. | |
| 5,579,598 | A | | 12/1996 | Fallon et al. | |
| 5,617,659 | A | * | 4/1997 | Okubo | 40/545 |
| 6,192,610 | B1 | * | 2/2001 | Fallon et al. | 40/545 |

* cited by examiner

*Primary Examiner*—Gary Hoge
(74) *Attorney, Agent, or Firm*—Michael Best & Friedrich LLP

(57) ABSTRACT

A display device has a support, a tubular light source, and a cover. The light source is interconnected to the support, and the cover is placed over the light source. The cover is an arc-shaped partially translucent elongated member. The cover is colored to create a glowing effect when light emitted from the light source passes through the cover in a forward direction. Light emitted from the light source in a rearward direction reflects off of the support. The cover allows the light source to create both a glowing effect and a back-lit effect.

13 Claims, 2 Drawing Sheets

GAS DISCHARGE TUBE COVER

This application claims the benefit of prior filed co-pending provisional patent application No. 60/296,667, filed on Jun. 7, 2001.

BACKGROUND OF THE INVENTION

This application relates to display devices, and more particularly to a display device having a light source.

Many types of display devices are used to capture the attention of the prospective customer. One way of capturing the attention of a person is the use of lighting.

SUMMARY OF THE INVENTION

The present invention comprises a display device that provides multiple light effects from the same light source. The display device includes a reflective surface, a tubular light source, and a cover. The tubular light source is preferably interconnected to a support, and the cover is placed over the light source. The light source preferably forms the shape of an object or symbol, and emits light toward the reflective surface.

The cover is a partially translucent elongated member having an arc-shaped or circular cross-section. Preferably, the cover is placed over the forward facing portion of the tubular light source. Some light emitted from the light source in a forward direction passes through the cover, and light emitted from the light source in a rearward direction reflects off of the reflective surface. The cover is preferably colored to create a glowing effect as light passes through the cover. The reflective surface is illuminated by white light that is emitted from the rearward facing portion of the tubular light source that is uncovered, transparent, translucent colored, or translucent uncolored.

The display device creates both a colored glowing lighting effect and a back-lit lighting effect from the same light source. Separate light sources are used in the prior art to create these two different lighting effects. Using the same light source to create both of these lighting effects reduces the cost of the display device, reduces the amount of energy consumed by the display device, and allows the display device to be constructed more efficiently.

These and other features of the present invention will be apparent to those skilled in the art from the detailed description of the invention and the drawings.

DETAILED DESCRIPTION

Figure 1:
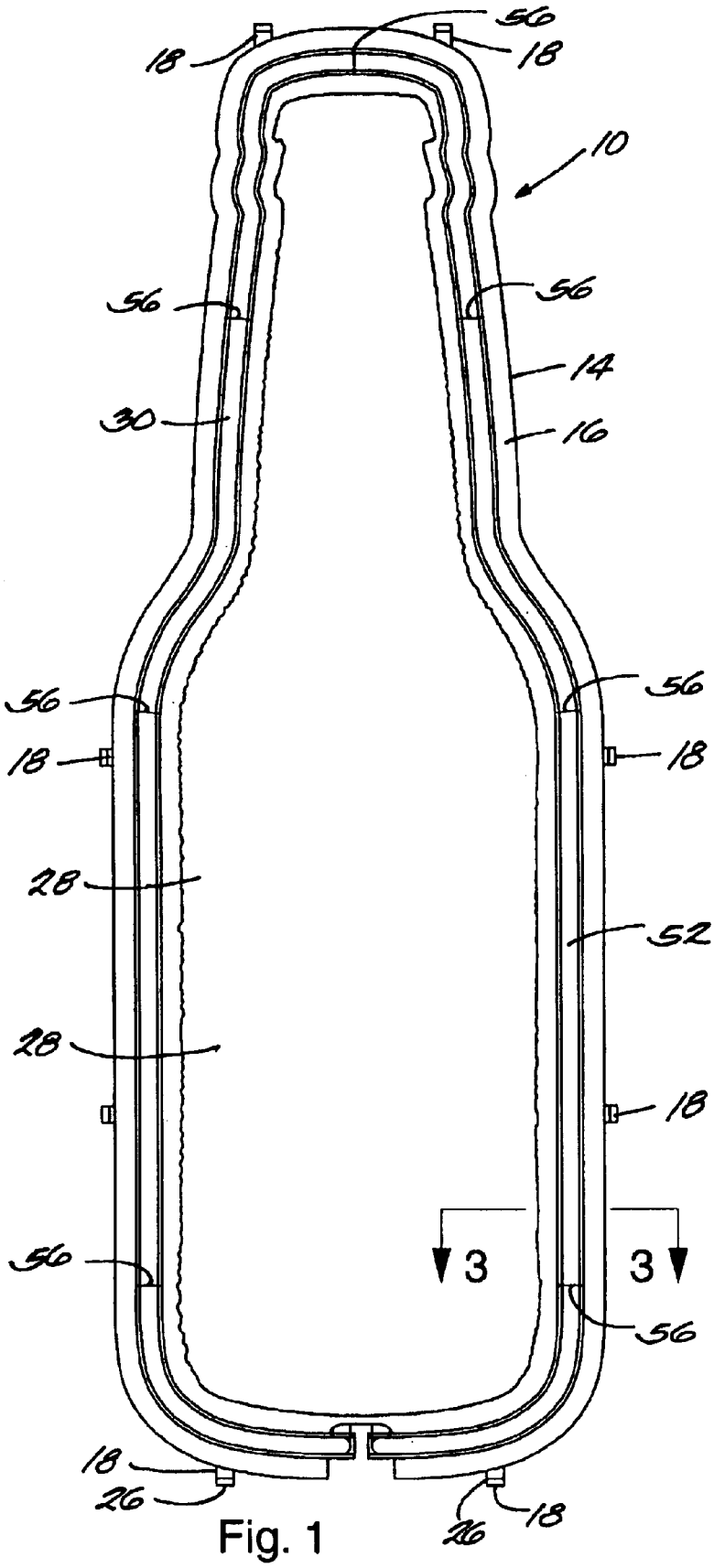
FIG. 1 is a front plan view of a display device according to the present invention.

In FIG. 1, a display device 10 is shaped like a bottle. Of course, any other shaped display device 10 may be used. In the preferred embodiment, the display device 10 includes a support 14 that is a relatively rigid member. The support 14 serves as a framework for the display device 10, and preferably includes a reflective surface 16 and braces 18. The braces 18 are rigid extensions that provide protection for the components of the display device 10. The braces 18 are spaced around the perimeter of the support 14 and generally project outward from the support 14. The display device 10 is preferably disposed resting upon a surface, but the display device 10 could also hang from a wall, ceiling, or other structure. When resting upon a surface, the braces 18 contacting the surface may form a base 26 that supports the display device. The base 26 is generally near the bottom of the display device 10.

The interior portion of the support 14 may have a graphic panel 28 that may be the focal point of the display device 10. The graphic panel 28 is generally a flat surface, but it could also be contoured. The graphic panel 28 may include pictures, designs, symbols, logos, models, text messages, or other similar graphic images. The shape of the support 14 and reflective surface preferably depends on the image on the graphic panel 28. In other embodiments, the graphic panel 28 may be eliminated.

The display device 10 also includes a tubular light source 30. In the preferred embodiment, the tubular light source 30 outlines and borders the graphic panel 28 and the support 14, however other arrangements of the tubular light source 30 in relation to the support 14 could also be used. For example, the tubular light source 30 could be shaped to create letters, numbers, symbols, or other designs.

The tubular light source 30 is preferably a gas tube light source, such as a fluorescent light, and can be constructed in various shapes. The tubular light source 30 usually produces white light, but other colored light sources, such as neon or mercury tubes, could also be used. The reflective surface 16 is a surface disposed in an area that is proximate to the tubular light source 30, and is preferably shaped to correspond to the shape of the light source 30. As viewed in FIG. 1, the reflective surface 16 is generally the surface approximately behind the tubular light source 30.

Figure 2:
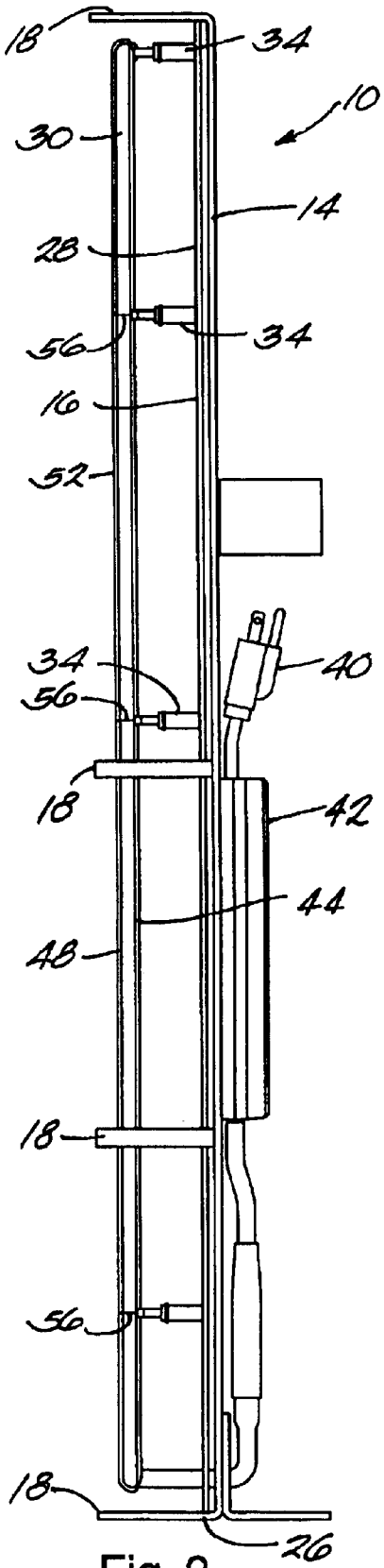
FIG. 2 is a side plan view of the display device of FIG. 1.

As viewed in FIG. 2, the tubular light source 30 is interconnected to the support 14 with multiple tube supports 34. The tube supports 34 are mounted to the support 14 and project away from the face of the support 14. The tubular light source 30 is coupled to the end of the tube supports 34 opposite the support 14. The tube supports 34 are spaced along the tubular light source 30 and hold the light source 30 in place. Also shown in FIG. 2 is a plug 40. The plug 40 may be plugged into a standard electrical outlet and provides power for the light source 30 through a power supply 42.

The display device 10 is generally intended to be viewed by a person from the perspective illustrated in FIG. 1. In FIG. 2, the portion of the tubular light source 30 that faces toward the reflective surface 16 is the rearward portion 44. The portion of the tubular light source 30 that faces away from the reflective surface 16 and toward the viewer is the forward portion 48. The rearward portion 44 generally faces in a rearward direction, and the forward portion 48 generally faces in a forward direction. As illustrated in FIG. 2, the rearward direction is from left to right, and the forward direction is from right to left.

A cover 52 is placed over the tubular light source 30. The cover 52 is an elongated member, and is preferably made from a flexible colored plastic extrusion, such as polyvinyl chloride. The cover 52 has an arc-shaped or circular cross-section. In the preferred embodiment, the extrusion is a tubular member that may be made in various colors. The extrusion is slit along its length to create the cover 52, and the cover 52 is then placed over the tubular light source 30. Wire ties 56 may be used to couple the cover 52 to the light source 30. Preferably, the cover 52 directly contacts the tubular light source 30, but the cover 52 could also be separated or set apart from the light source 30. Additionally, the cover 52 could be co-extruded with a forward-facing section and a rearward-facing section. The forward-facing section is preferably translucent and colored, and the rearward-facing section is at least one of transparent, translucent and colored, or translucent and uncolored. In the co-extruded embodiment, the forward-facing section is placed over the forward portion 48, and the rearward-facing section is placed over the rearward portion 44.

Figure 3:
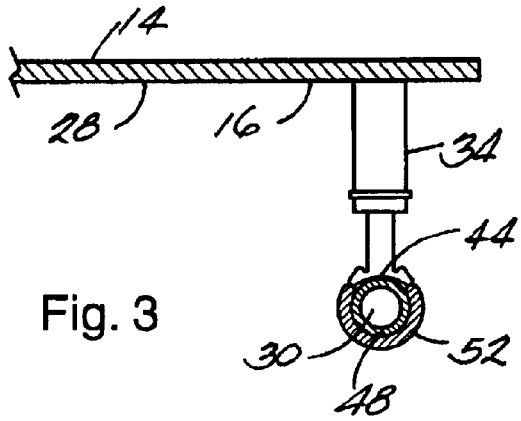
FIG. 3 is a cross-sectional view, taken along line 3—3 of FIG. 1, illustrating the display device of FIG. 1.

In the preferred embodiment, as illustrated in FIG. 3, the cover 52 is generally placed on the forward portion 48 of the tubular light source 30, and allows the tubular light source 30 to create both a glowing lighting effect and a back-lit lighting effect. As illustrated in FIG. 3, the rearward direction is from bottom to top in the figure, and the forward direction is from top to bottom in the figure. Light emitted from the light source 30 in a generally forward direction passes through the cover 52 before reaching the viewer. The light passing through the cover 52 gives the appearance of a colored light and creates the glowing lighting effect. The glowing lighting effect provides the appearance that the tubular light source 30 is glowing in the color of the cover 52.

Light emitted from the tubular light source 30 in a rearward direction either does not pass through the cover 52, or passes through the rearward-facing section of the cover 52. In either case, light emitted in a rearward direction remains white light, or is the color of the rearward-facing section of the cover 52. The white light from the rearward portion 44 of the light source 30 preferably illuminates the graphic panel 28. The graphic panel 28 and reflective surface 16 are preferably diffusively reflective and reflect the white light. The reflected white light from the graphic panel 28 and reflective surface 16 creates the back-lit lighting effect for the viewer. The back-lit lighting effect is created when a surface is indirectly illuminated and the source of the light is not directly seen by the viewer.

The tubular light source 30 is generally spaced from the reflective surface 16 and graphic panel 28 with tube supports 34. Slightly separating the light source 30 from the graphic panel 28 enhances the back-lit effect of the display device 10 and provides additional space for the white light to dissipate and reflect off of the graphic panel 28. The tubular light source 30 may be placed directly against the reflective surface 16 or graphic panel 28, but the back-lit lighting effect may not be as conspicuous if the light source 30 is too close to the reflective surface 16 or graphic panel 28. The optimum distance between the light source 30 and the reflective surface 16 for the back-lit lighting effect will depend on the size and design of the display device 10.

The display device 10 with the tubular lighting source 30 and cover 52 produces the both the glowing lighting effect and the back-lit lighting effect from the same light source 30. Previously, separate light sources have been used to create these two different lighting effects. The present invention has the advantage of providing both of these desirable lighting effects from the same light source 30. Using the same light source 30 reduces the cost of manufacturing the display device 10, reduces the cost of operating the display device 10, and allows the display device 10 to be constructed more efficiently.

While several embodiments of the invention have been shown and described, alternate embodiments will be apparent to those skilled in the art and are within the intended scope of the present invention.

What is claimed is:

1. A display device comprising:

a tubular light source:

a reflective surface adjacent to the light source;

a cover disposed on the light source, wherein the cover has at least one of an arc-shaped and a circular shaped cross-section, and is disposed such that a rearward portion of the light source emits light that is reflected off of the reflective surface, the cover including a rearward-facing section facing toward the reflective surface and a forward-facing section facing away from the reflective surface, the forward-facing section being colored with a first color, and the rearward-facing section being at least one of uncolored and colored with a second color different from the first color.

2. The display device of claim 1, wherein the rearward-facing section and the forward-facing section extend axially along the length of the tubular light source.

3. A display device comprising:

a tubular light source;

a reflective surface adjacent to the light source; and a cover disposed on the light source, wherein the cover has at least one of an arc-shaped and a circular shaped cross section, and is disposed such that a rearward portion of the light source emits light that is reflected off of the reflective surface;

wherein the cover is coupled to the light source with wire ties.

4. A method of constructing a display device comprising the steps of:

providing a reflective surface;

providing a tubular light source spaced from the reflective surface, the tubular light source having a cross-section with a first circumference;

providing a tubular extrusion having a cross-section with a second circumference being smaller than the first circumference;

slitting the tubular extrusion; and placing the tubular extrusion on the tubular light source, such that the cover does not extend completely around the tubular light source in a radial direction.

5. The method of claim 4, wherein the tubular extrusion is placed on a forward portion of the tubular light source.

6. A display device comprising:

a reflective surface;

a tubular light assembly positioned adjacent the reflective surface and including:

a tubular light source and a cover disposed on the tubular light source and having at least one of an arc-shaped and a circular shaped cross section, the tubular light assembly emitting light having a first color in a first direction toward the reflective surface and emitting light having a second color in a second direction away from the reflective surface, the second color being different than the first color.

7. The display device of claim 6, wherein the cover includes a forward-facing section facing away from the reflective surface and a rearward-facing section facing toward the reflective surface, the forward-facing section being translucent and colored and the rearward-facing section being translucent and uncolored.

8. The display device of claim 6, wherein the cover includes a forward-facing section facing away from the reflective surface and a rearward-facing section facing toward the reflective surface, the forward-facing section being translucent and colored with a first color and the rearward-facing section being translucent and colored with a second color being different than the first color.

9. The display device of claim 6, wherein the cover includes a forward-facing section facing away from the reflective surface and a rearward-facing section facing toward the reflective surface, the forward-facing section being translucent and colored and the rearward-facing section being transparent.

10. The display device of claim 6, wherein the cover has a cross-sectional shape that does not extend completely around a tubular light source in a radial direction, and the tubular light assembly includes an exposed portion extending in an axial direction along the tubular light source, the exposed portion facing the reflective surface and permitting light emitted from the tubular light source to reach the reflective surface unobstructed by the cover.

11. The display device of claim 6, wherein the cover directly contacts the tubular light source.

12. A method of constructing a display device comprising the acts of:

providing a reflective surface;

providing a tubular light source spaced from the reflective surface;

providing a tubular extrusion;

slitting the tubular extrusion;

placing the tubular extrusion on the tubular light source; and emitting light having a first color from the tubular light source away from the reflective surface and emitting light being at least one of uncolored and a second color different from the first color from the tubular light source toward from the reflective surface.

13. The method of claim 12, wherein the act of placing the tubular extension on the tubular light source includes exposing a portion of the tubular light source extending linearly in an axial direction along the length of the tubular light source.

* * * * *